United States Patent [19]

Howlett

[11] 4,374,560

[45] Feb. 22, 1983

[54] COLLAPSIBLE DISPLAY BIN STAND

[75] Inventor: Robert J. Howlett, Edison, N.J.

[73] Assignee: Container Corporation of America, Chicago, Ill.

[21] Appl. No.: 330,165

[22] Filed: Dec. 14, 1981

[51] Int. Cl.[3] ..... B65D 5/50; B65D 5/52; B65D 85/00; A45D 19/04

[52] U.S. Cl. ..... 206/44 R; 206/45.19; 206/45.31; 229/41 C; 248/174

[58] Field of Search ..... 206/44 R, 45.19, 45.31, 206/45.14; 229/41 C, 37

[56] References Cited

U.S. PATENT DOCUMENTS

| | | | |
|---|---|---|---|
| 1,911,073 | 5/1933 | Dyment | 229/41 C |
| 1,962,833 | 6/1934 | Nuckols | 248/174 |
| 2,715,509 | 8/1955 | Paige | 229/41 C |
| 3,330,406 | 7/1967 | Taub | 206/45.31 |

*Primary Examiner*—William T. Dixson, Jr.
*Attorney, Agent, or Firm*—Richard W. Carpenter; Davis Chin

[57] ABSTRACT

A collapsible, bin-type, display stand having a polygonal-shaped receptacle member supported by a plurality of contiguous polygonal-shaped tubular structures.

6 Claims, 7 Drawing Figures

COLLAPSIBLE DISPLAY BIN STAND

BACKGROUND OF THE INVENTION

1. Field of the Invention

This invention relates generally to display stands, and more particularly to a paperboard, bin-type, collapsible, display stand.

2. Description of the Prior Art

A prior art search in the United States Patent and Trademark Office directed to the subject matter and this invention disclosed the following United States Letters Pat. Nos.: 1,916,471; 1,947,168; 2,012,117; 2,041,751; 2,049,659; 2,106,301; 2,659,483; 2,766,893; 3,089,632; 3,300,166; 3,403,835; 3,685,775; 3,825,216; 3,837,719; 3,918,576; 4,164,316.

None of the prior art uncovered in the search disclosed a collapsible, bin-type, display stand including a polygonal-shaped upper receptacle member supported by a base member which includes a plurality of contiguous, polygonal-shaped tubes.

SUMMARY OF THE INVENTION

It is an object of the invention to provide a collapsible, bin-type, display stand which includes an upper receptacle member, for holding the articles to be displayed, and a base member, for supporting the receptacle member.

A more specific object of the invention is the provision, in a display stand of the type described, of an upper receptacle member which is supported by a base member comprising a plurality of contiguous tubular structures.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
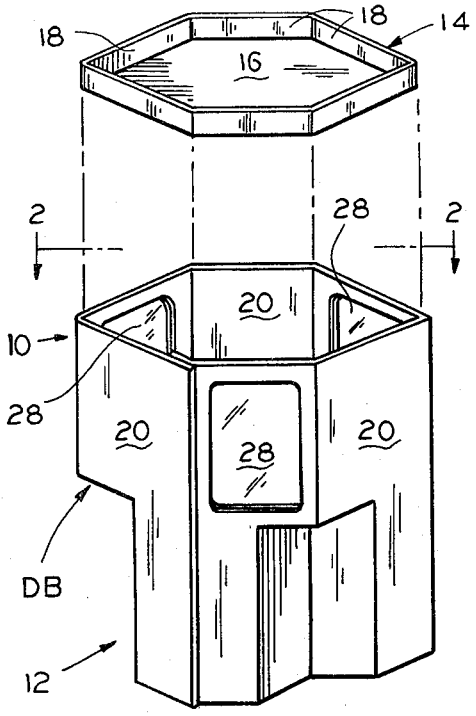
FIG. 1 is an exploded perspective view of a display stand emboding features of the invention.
Figure 3:
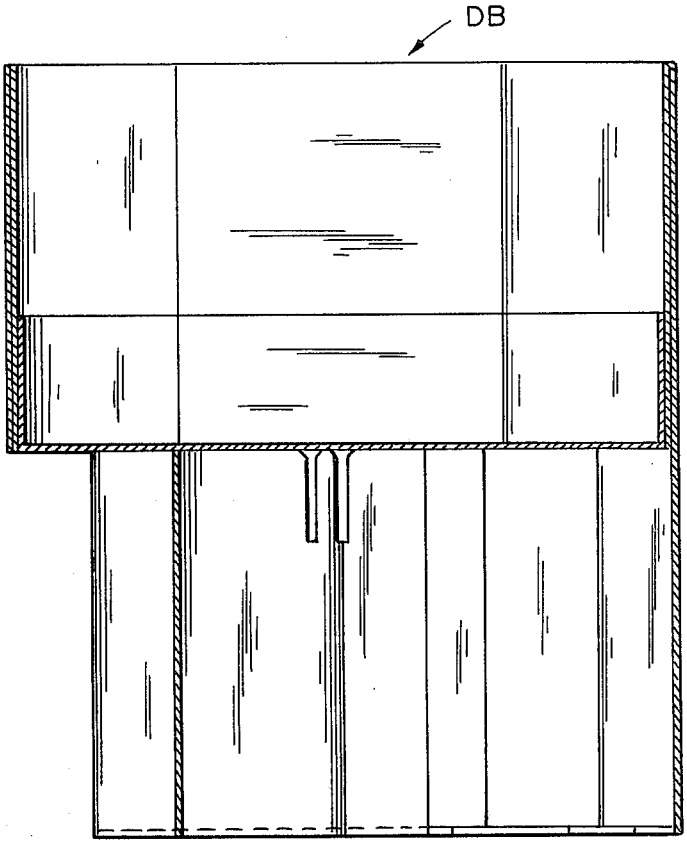
FIG. 3 is a transverse, vertical, sectional view taken on line 3—3 of FIG. 2.
Figure 2:
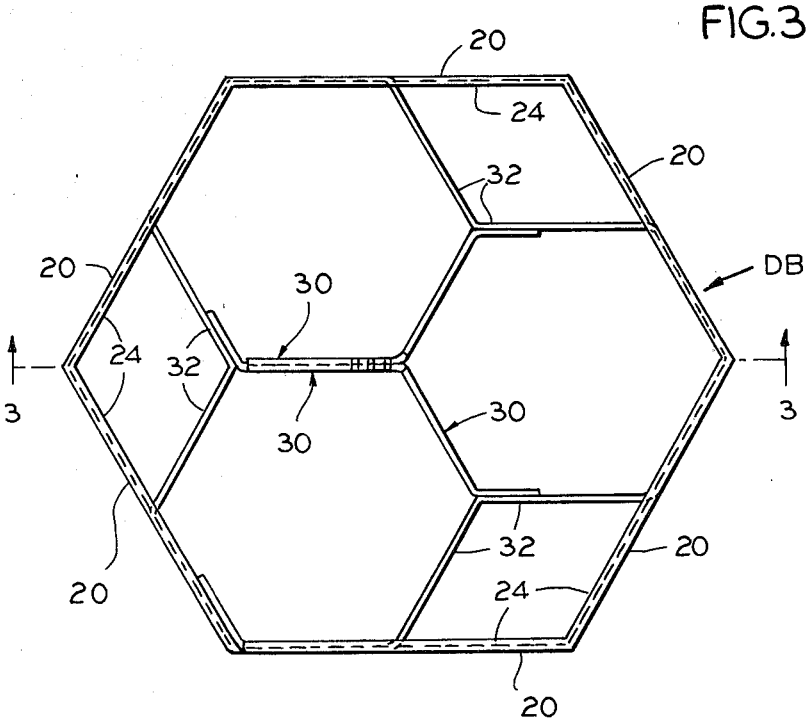
FIG. 2 is a transverse, horizontal, sectional view taken on line 2—2 of the FIG. 1.

Referring now the drawings for a better understanding of the invention, and particularly to FIGS. 1 and 2, it will be seen that the novel collapsible display stand, indicated generally at DB, is preferably hexagonal in shape and includes an upper or receptacle member, indicated generally at 10, which is supported by a lower or base member, indicated generally at 12.

The receptacle member 10 is adapted to hold articles to be displayed and sold therefrom. It includes a floor or deck, indicated generally at 14, which includes a polygonal-shaped center panel 16 having a plurality of side flanges 18 foldably joined to the sides thereof along fold lines 19.

Figure 4:
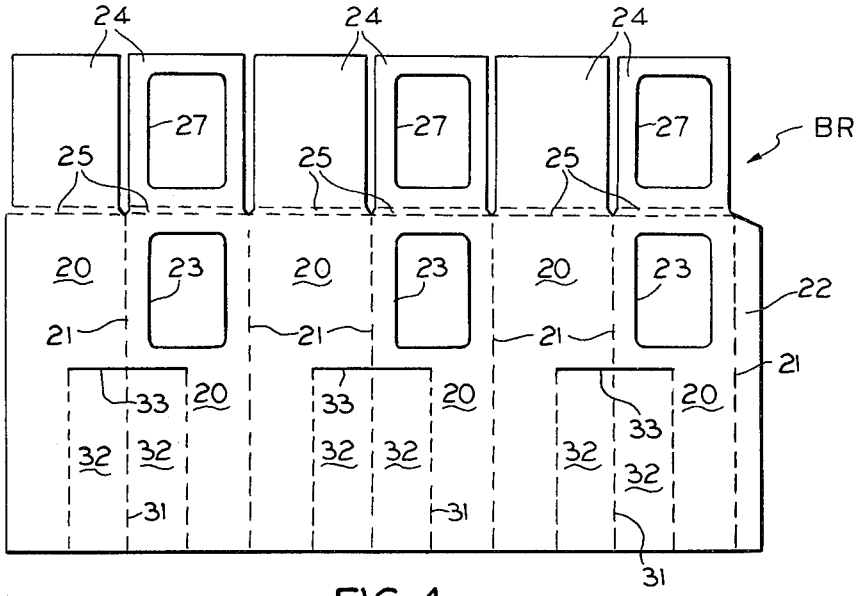
FIG. 4 is a plan of a blank of foldable sheet material, such as paperboard, from which the major portion of the structure illustrated in the previous views may be formed.

The main portion of the structure is formed from the blank B of foldable sheet material illustrated in FIG. 4. This structure includes a plurality of main or outer panels 20 which extend the entire height of the stand and are each generally in the form of a inverted L, with the wider portion at the top and the narrower portion at the bottom. For purposes of illustration the stand is a hexagonal stand; however, it would be possible to have an octagonal stand utilizing certain the basic principles of the present invention.

Still referring to FIG. 4, it will be seen that the structure includes six main panels 20 and a glue flap 22, which are foldably joined to each other on parallel fold lines 21, with glue flap 22 being secured to the remote side panel 20 to provided a tubular structure open at the top and bottom.

If desired, in order to provide a more attractive display, certain of the panels 20 may be provided with openings 23 to form windows in the receptacle member of the display stand.

In order to reinforce the upper portion of the stand there may be provided a plurality of inner panels 24, which are of substantially the same dimensions as the upper portions of panels 20, an which are foldably joined to the respective panels 20 along aligned, preferably double score lines 25. Certain of the panels 24 may also be provided with openings 27, so that when the inner panels are folded against and secured to the inner faces of panels 20 and the window openings of the respective panels will be aligned with each other. Squares of plastic 28 may be interposed between the panels to provide transparent windows for the receptacle member of the stand.

The primary area of novelty in the present invention resides in the unique construction of the base member of the stand which serves to support the receptacle member.

As best seen in FIG. 2, the base member comprises a plurality of hexagonally-shaped tubular structures, indicated generally at 30. Each of the structures has two sides formed by the lower portions of adjacent main panels 20, another two sides formed by panels 32, which are cut from and foldably joined on fold lines 31 to the related lower portions of adjacent panels 20, and the remaining two sides formed from portions of a generally Y-shaped core or insert, indicated generally at 40. Each pair of panels 30 may be separated from the upper portions of related panels 20 by cut lines 33.

Figure 5:
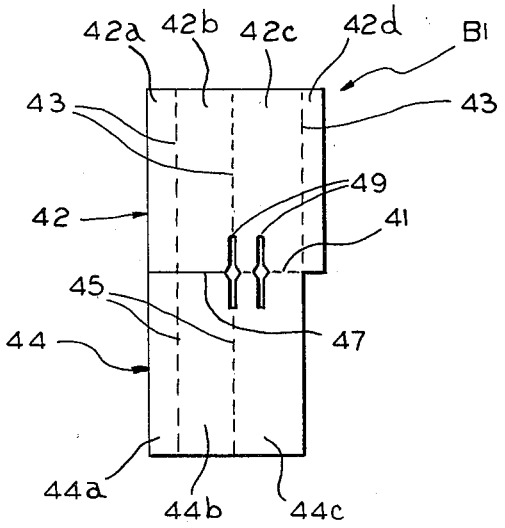
FIG. 5 is a plan view of a blank of foldable sheet material which may be used to form a portion of the supporting structure illustrated in FIG. 2.
Figure 6:
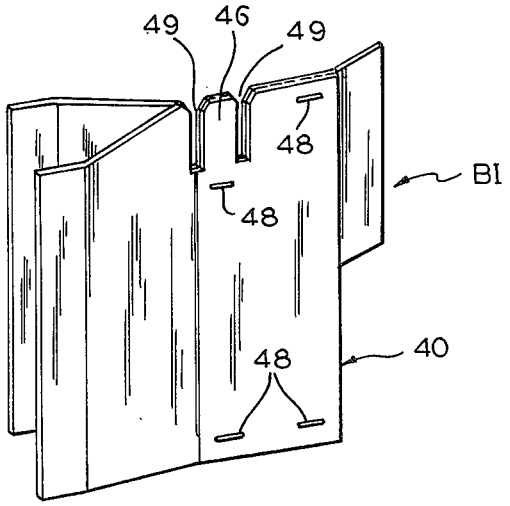
FIG. 6 is a perspective view of a portion of the supporting structure illustrated in FIG. 2 and formed from the blank illustrated in FIG. 5.
Figure 7:
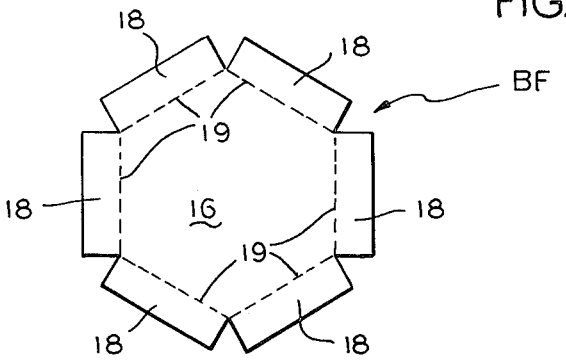
FIG. 7 is a plan view of another blank of foldable sheet material from which the floor element illustrated in FIG. 1 may be formed.

Insert 40, as best seen in FIGS. 5 and 6, includes a first section 42 having a first panel 42*a*, a second panel 42*b*, a third panel 42*c*, and a fourth panel 42*d*, which are foldably joined to each other on parallel fold lines 43; and a second section 44 which includes a first panel 44*a*, a second panel 44*b*, and a third panel 44*c*, which are foldably joined which are foldably joined to each other on parallel fold lines 45. First and second sections 42 and 44 are foldably joined to each other along a fold line 41, with portions of the sections being separated from each other by a cut line 47 which is aligned with fold line 41.

In order to form the insert into erected position first and second sections are folded in face-to-face relation, with third panel 42*c* of one section secured to third panel 44*c* of the other section in any desired manner, such as by staples 48. Also, if desired the insert may be provided with a pair of parallel slots 49 extending downwardly from the upper edge thereof which provide therebetween a projection 46 adapted to receive the lower end of a sign supporting pole.

As best seen in FIG. 2, panels 42*a* and 44*a* of insert 40 may be secured to two of the inner panels 32 of the base member, with fourth panel 42*d* of the insert being secured to a third inner panel 32, so that the insert, which is Y-shaped, cooperates with other panels 20 and 32 to provide a plurality of contiguous hexagonal-shaped tubes for supporting the receptacle member of the stand while still permitting the entire device to be collapsed when floor or deck member 14 is removed.

To erect the stand, one merely has to grasp opposite sides of the receptacle member and pull them apart. As this is being done the core of the base member will be automatically erected to the position of FIG. 2. At this point the floor or deck section 14 may be inserted into the receptacle member of the stand on the upper portions of the base member tubular structures, with the side flanges 18 disposed in face-to-face relation with the insides of the stand receptacle member.

Thus, it will be appreciated that the invention includes a unique means of supporting a bin-type display stand by utilizing a plurality of contiguous tubular structures.

What is claimed is:

1. A collapsible, automatically erectable, display bin stand formed of foldable sheet-material such as paperboard, comprising:

(a) a hexagonal-shaped, upper, receptacle member, supported by a base member which includes a plurality of hexagonal-shaped tubes;

(b) said stand including six generally inverted, L-shaped, side panels extending substantially the entire height of said stand and being joined to each other on parallel fold lines to form a tubular structure;

(c) said side panels having integral upper and lower portions which form parts of the receptacle and base members, respectively;

(d) said base member including a plurality of panels joined to said side panel lower portions and to each other on parallel fold lines to form said hexagonal-shaped tubes;

(e) a floor panel in said receptacle member supported on said base member.

2. A collapsible, automatically erectable, display bin stand formed of foldable sheet-material such as paperboard, comprising:

(a) a polygonal-shaped upper, receptacle member, supported by a base member which includes a plurality of contiguous, polygonal-shaped tubes;

(b) said stand including a plurality of side panels extending substantially the entire height of said stand and being joined to each other on parallel fold lines to form a tubular structure;

(c) said side panels having integral upper and lower portions which form parts of the receptacle and base members, respectively;

(d) said base member including a plurality of center panels joined to said side panel lower portions and to each other on parallel fold lines to form a plurality of contiguous tubular structures;

(e) a floor panel in said receptacle member supported on said base member.

3. A stand according to claim 2, wherein said receptacle member is hexagonal.

4. A stand member according to claim 2, wherein each of said tubes are hexagonal.

5. A stand according to claim 2, wherein said side panels are each in the shape of an inverted L.

6. A stand according to claim 2, wherein said center panels are part of a separate Y-shaped insert.

* * * * *